United States Patent [19]

Moen et al.

[11] Patent Number: 5,056,350

[45] Date of Patent: Oct. 15, 1991

[54] APPARATUS AND METHOD FOR STRIPPING A WORKPIECE FROM A SUPPORTING DEVICE

[75] Inventors: Bruce A. Moen, Golden; Warren R. Williams, Fort Collins; Bert E. Johansson, Arvada; Leo W. Mayer, Lakewood, all of Colo.

[73] Assignee: Coors Brewing Company, Golden, Colo.

[21] Appl. No.: 562,747

[22] Filed: Aug. 6, 1990

[51] Int. Cl.[5] ..... B21D 45/08

[52] U.S. Cl. ..... 72/345

[58] Field of Search ..... 72/345, 348

[56] References Cited

U.S. PATENT DOCUMENTS

| | | | |
|---|---|---|---|
| 3,635,069 | 1/1972 | Eickenhorst . | |
| 3,654,796 | 4/1972 | Dunn | 72/345 |
| 3,771,344 | 11/1973 | Wright . | |
| 3,952,573 | 4/1976 | Sorensen . | |
| 3,967,482 | 7/1976 | Kubecki et al. . | |
| 4,224,819 | 9/1980 | Kaminskas . | |
| 4,280,333 | 7/1981 | Murphy . | |
| 4,362,037 | 12/1982 | Whitfield | 72/345 |
| 4,546,636 | 10/1985 | Snyder et al. | 72/345 |

*Primary Examiner*—Lowell A. Larson
*Attorney, Agent, or Firm*—Klaas & Law

[57] ABSTRACT

Apparatus and method for stripping a can body having an open end and a closed end from the punch on a reciprocating ram of a can body making apparatus wherein a cavity exists between the closed end and the punch and wherein the ram has a forward stroke and a return stroke by moving the closed end into contact with doming apparatus during the forward stroke to move a valve from a closed to an opened position to feed air under pressure into the cavity to hold the closed end against the doming apparatus during the return stroke until the can body is separated from the punch and ejecting the stripped can body from the doming apparatus.

19 Claims, 5 Drawing Sheets

APPARATUS AND METHOD FOR STRIPPING A WORKPIECE FROM A SUPPORTING DEVICE

FIELD OF THE INVENTION

This invention relates generally to apparatus for stripping a cylindrical workpiece from a cylindrical supporting device and, more particularly, to apparatus for stripping a one-piece can body from the punch of a can body making machine during the return stroke of the punch.

BACKGROUND OF THE INVENTION

Conventional can body making machines employ a removable tool pack assembly and a removable stripper assembly which are removably mounted in a forming cavity of the machine. Conventional stripper assemblies comprise an annular ring support structure on which are mounted a plurality of separate circumferentially spaced apart fingers to form a generally circular opening. The fingers are mounted to provide for individual radially inward or outward movement. In some instances the fingers are resiliently urged against the outer surface of the punch during the return stroke so as to contact the leading edge of the can body to disengage it from the punch. In other instances, the fingers are located to be spaced a very small distance from the outer surface of the punch so that during the return stroke of the punch the fingers contact the leading edge of the can body to disengage it from the punch. In many instances, air is also used in the stripping operation. While these stripper assemblies remove a can body from the punch, they are formed using a great number of separate members so that there exists a need for a stripping assembly of a much less complicated structure. Also, such strippers tend to scratch the outer can surface which may led to appearance of functional problems.

BRIEF DESCRIPTION OF THE INVENTION

This invention provides apparatus and method for stripping a cylindrical workpiece, such as a can body having an open end and a closed end, from a cylindrical supporting device, such as a punch of a can body making apparatus, which cylindrical supporting device is mounted on a reciprocating ram wherein the cylindrical workpiece is stripped, using only air under pressure which is fed into a cavity between the closed end of the cylindrical workpiece and the cylindrical supporting device immediately before the end of the forward stroke of the ram to hold the closed end against a relatively fixed abutment, such as doming means, during the return stroke of the ram to disengage the cylindrical workpiece from the cylindrical supporting device. Also, additional force applying means are provided for applying an axially directed force on the cylindrical workpiece after it has been stripped from the cylindrical supporting device to move it away from the relatively fixed abutment.

In the normal operation of a can body forming apparatus, the cylindrical workpiece and the cylindrical supporting device are moved through the forming dies, the stripping apparatus and against the doming means in a forward stroke and during the return stroke the cylindrical workpiece is stripped or removed from the cylindrical supporting device. In a preferred embodiment of this invention, a ram having a cylindrical supporting device, such as a punch secured thereto, is mounted for reciprocal movement and has a forward stroke and a return stroke along a longitudinal axis. A cylindrical workpiece, such as a can body, is supported on the cylindrical supporting device. Doming means are mounted at a relatively fixed location and are located to be contacted by the closed end of the cylindrical workpiece as the cylindrical supporting device moves in the forward stroke. Conventional doming means provide for a slight cushioning movement. After contact, the continued movement of the cylindrical supporting device forms a dome in the closed end. Valve means are mounted on the cylindrical supporting device and have a stem portion which is movable between closed and opened positions. A supply of fluid under pressure, such as air, is provided to an internal cavity in the ram. The valve means are mounted on the cylindrical supporting device so that a cavity is formed between the valve means and the closed end of the cylindrical workpiece. At least one passageway extends through the stem portion and when the stem portion is in the opened position, the passageway has one end thereof in fluid communication with the supply of fluid under pressure and the other end thereof in fluid communication with the cavity between the valve means and the closed end. The stem portion is located so that, when the closed end of the cylindrical workpiece is being moved over the doming means, the closed end contacts the stem portion to move it from a closed position to an opened position so that fluid under pressure will move through the valve means to enter into the cavity to hold the closed end against the doming means so that, as the cylindrical supporting device moves in the return stroke, the cylindrical workpiece remains stationary so that it is stripped from the cylindrical supporting device. The additional force applying means are located in the doming means and apply an axially directed force on the closed end to move the stripped cylindrical workpiece away from the doming means after the punch is withdrawn. The additional force applying means comprise a piston mounted for reciprocation in a cavity in the doming means which piston having a projecting portion capable of movement through an opening in the cavity. Spring means urge the piston in an axial direction so that the projecting portion moves through the opening to apply a force on the closed end of the stripped cylindrical workpiece to move it away from the doming means.

The valve means are mounted in the internal cavity formed in the end portion of the ram. At least one longitudinally extending passageway formed in the ram has one end thereof in fluid communication with a supply of fluid under pressure and the other end thereof in fluid communication with the internal cavity. A valve body has one end portion thereof mounted in the internal cavity and has at least one longitudinally extending passageway therein having an inner surface. The valve body has an end surface facing the internal cavity. The stem portion comprises a piston and a piston rod mounted in the at least one longitudinally extending passageway in the valve body for movement between closed and opened positions and during the forward stroke of the ram, the stem portion is in the closed position. At least one passageway extends through the piston and piston rod with one end of the passageway being in fluid communication with the cavity when the piston and piston rod are in a closed or an opened position and the other end of the passageway in the piston and piston rod being radially opposite the inner surface of the passageway in the valve body when the piston and piston rod are in the closed position so that the other end is not in fluid communication with the supply of fluid under pressure. The other end of the passageway in the piston and piston rod is located in the internal cavity when the piston and piston rod have been moved to the opened position so that the other end of the passageway is in fluid communication with the supply of fluid under pressure so that fluid under pressure moves through the passageway in the piston and piston rod and into the cavity. Sealing means are provided between the valve body and the piston rod when the piston and piston rod are in a closed position to prevent entry of the fluid under pressure into the passageway in the piston and piston rod. An annular space is located between the piston and the valve body and vent means are provided to connect the annular space to atmospheric pressure.

After the piston and piston rod have been moved to the opened position, the force of the pressurized fluid in the cavity between the valve means and the closed end of the cylindrical workpiece must be larger than the combination of the force exerted by the resilient means, the inertial force acting on the piston and piston rod due to the acceleration of the cylindrical supporting device in the return stroke and the force of the fluid under pressure acting on the sealing means on the piston rod. When the cylindrical workpiece has been stripped from the cylindrical supporting device, the cavity is opened to atmosphere so that the resilient force, the inertial force and the force of the fluid under pressure acting on the sealing means on the piston rod are greater than atmosphere and move the piston and piston rod to the closed position. On the forward stroke, the resilient force and the force of the fluid under pressure on the sealing means are greater than the inertial force on the piston and piston rod during the forward stroke to hold the piston and piston rod in a closed position until it is moved to the opened position as described above.

In one preferred embodiment of the invention, at least a portion of the inner surface of the passageway in the valve body is cylindrical and extends in an axial direction. A bushing having cylindrical outer and inner surfaces is mounted in the passageway in the valve body and is in frictional engagement with the inner surface of the passageway in the valve body to prevent relative movement therebetween. The bushing has an axial extent less than the axial extent of the at least a portion of the inner surface so as to form an abutment shoulder. The piston and piston rod have outer cylindrical surfaces with the outer cylindrical surface of the piston rod having a diameter slightly less than the diameter of the inner surface of the bushing to permit reciprocal movement of the piston rod through the bushing. The piston rod has a diameter less than the diameter of the at least a portion of the inner surface of the passageway in the valve body to form a longitudinally extending annular opening therebetween. An abutment is formed on the piston. At least a portion of a resilient means is located in the annular opening and has one end thereof in contact with the abutment shoulder and the other end thereof in contact with the abutment to urge the piston and piston rod toward the closed position. The forces exerted by the resilient means are very small in value and are only provided to ensure that the stem portion is normally in the closed position particularly when there is no pressurized air in the internal cavity.

In another preferred embodiment of the invention at least a portion of the inner surface of the valve body has two cylindrical portions of differing diameters to form an abutment shoulder therebetween. At least a portion of the piston has an outer surface having two cylindrical surfaces of differing diameters to form an abutment shoulder therebetween. The inner and outer surfaces cooperate to form a longitudinally extending annular opening therebetween with the resilient means being located in the annular opening and in contact with the abutment shoulders to urge the piston and piston rod toward the closed position.

In another preferred embodiment of the invention, the inner surface of the valve body has at least two cylindrical portions of differing diameters. The piston rod has a cylindrical outer surface which is in mating engagement with the portion of the inner surface having the smaller diameter to guide the movement of the piston rod between the closed and opened positions. The piston has a cylindrical outer surface and is radially opposite to a portion of the inner surface having the larger diameter and has a diameter smaller than the diameter of the portion of the inner surface having the larger diameter to form an annular space therebetween. A diaphragm is mounted on the valve body and the piston to seal off the annular space.

In another preferred embodiment of the invention, the inner surface of the valve body has at least two cylindrical portions of differing diameters. The piston and piston rod have outer cylindrical surfaces of differing diameters. The inner surfaces and the outer surfaces are in mating engagement to guide the movement of the piston and piston rod between the closed and opened positions. A vent passageway is formed in the piston and has a one way valve therein to permit movement of air from a cavity between the piston and valve body into the cavity between the valve means and the closed end of the cylindrical object.

BRIEF DESCRIPTION OF THE DRAWINGS

Illustrative and presently preferred embodiments of the invention are shown in the accompanying drawings in which.

DETAILED DESCRIPTION OF THE INVENTION

Figure 1:
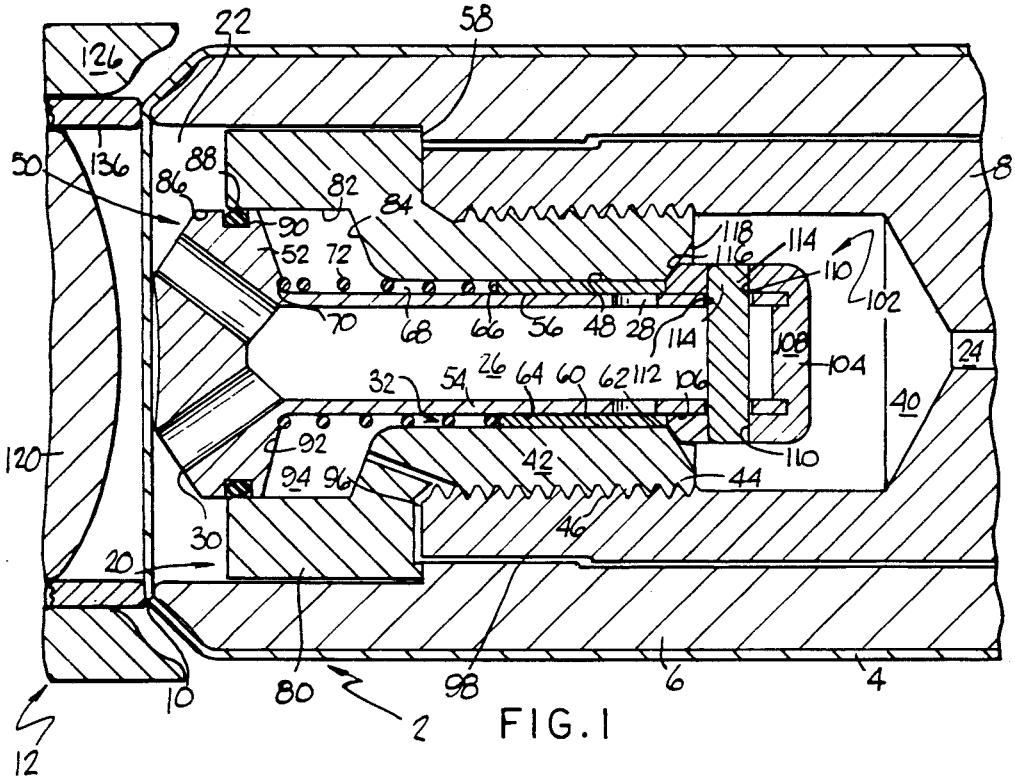
FIG. 1 is an elevational view with parts in section of one preferred embodiment of the invention in a closed position.
Figure 2:
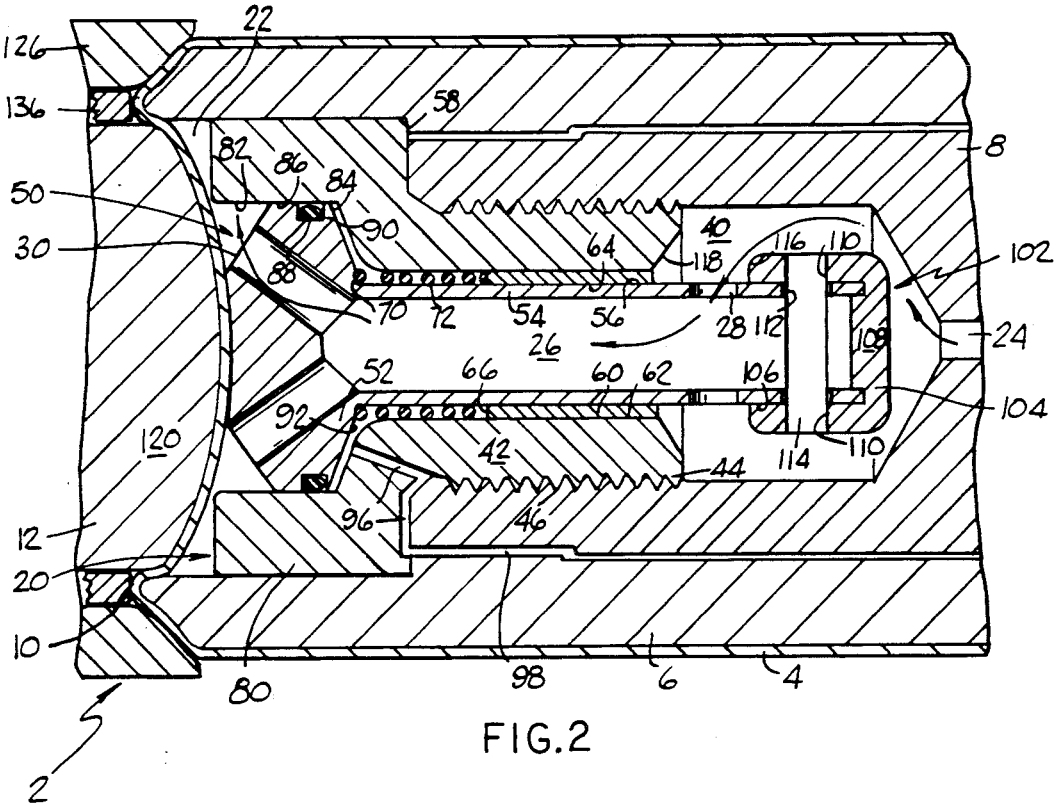
FIG. 2 is an elevational view as in FIG. 1 with the invention in an opened position.

One preferred embodiment of the invention is illustrated in FIGS. 1 and 2 and comprises air stripping apparatus 2 for stripping a cylindrical workpiece 4, such as a can body, from a cylindrical supporting device 6, such as a punch, mounted on a reciprocating ram 8 of a can body making machine (not shown). In normal operation, the cylindrical workpiece 4 and the cylindrical supporting device 6 are moved through the stripping apparatus in a forward stroke of the reciprocating ram 8 and during the return stroke the cylindrical workpiece 4 is disengaged from the cylindrical supporting device 6. The cylindrical workpiece 4 has an open end (not shown) and a closed end 10. Conventional doming means 12 are located so that the closed end 10 of the cylindrical workpiece 4 moves into contact therewith during the forward stroke of the reciprocating ram 8.

Valve means 20 are mounted on the reciprocating ram 8 and are located within the cylindrical supporting device 6. The valve means 20 are operable between a closed position, illustrated in FIG. 1, and an opened position, illustrated in FIG. 2. The valve means 20 are mounted on the ram 8 so that there is a cavity 22 formed between the valve means 20 and the closed end 10. The ram 8 has a passageway 24 which is connected to a supply of fluid, such as air, under pressure (not shown). At least one passageway 26 extends through the valve means 20 and, when the valve means 20 are in the opened position, the passageway 26 has openings 28 in one end portion in fluid communication with the passageway 24 and the supply of fluid under pressure, and openings 30 in the other end portion in fluid communication with the cavity 22. Resilient means 32, described more fully below, are provided for urging the valve means 20 toward the closed position. Moving means, described more fully below, are provided to move the valve means 20 from the closed position to the opened position so that the fluid under pressure is forced into the cavity 22 to force the closed end 10 against the doming means 12 to prevent relative movement therebetween as the reciprocating ram 8 moves the cylindrical supporting device 6 in the return stroke so that the cylindrical workpiece 4 is stripped from the cylindrical supporting device 6. Retaining means comprising the fluid under pressure in the cavity 22 hold the valve means 20 in the opened position until the cylindrical supporting device 6 has moved out of the cylindrical workpiece 4.

An internal cavity 40 is formed by the valve means 20 in an internal end portion of the reciprocating ram 8 which internal cavity 40 is in fluid communication with the passageway 24. A valve body 42 has one end portion 44 mounted on the reciprocating ram 8 by the threaded connection 46. The valve body 42 has a longitudinally extending passageway having a generally cylindrical inner surface 48. A movable stem portion 50 comprising a piston 52 and an integral piston rod 54 having a generally cylindrical outer surface 56 is mounted in the valve body 42 for movement between closed and opened positions. The piston 52 and the piston rod 54 have the passageway 26 extending therethrough with the openings 30 in one end thereof in fluid communication with the cavity 2 when the piston 52 and piston rod 54 are in the closed or opened positions. The piston openings 28 of the passageway 26, when piston 52 and piston rod 54 are in a closed position, are not in fluid communication with the internal cavity 40, described more fully below, but, when the piston 52 and piston rod 54 are in the opened position, illustrated in FIG. 2, the openings 28 are located in the internal cavity 40 so that they are in fluid communication with the supply of fluid under pressure so that the fluid under pressure moves through the passageway 26 to hold the closed end 10 against the doming means 12. When the valve body 42 is threaded into the ram 8, a sealed relationship 58 is established between the valve body 42 and the cylindrical supporting device 6 to prevent the passage of fluid therebetween.

One preferred embodiment of the valve means 20 is illustrated in FIGS. 1 and 2. A bushing 60 having a cylindrical outer surface 62 and a cylindrical inner surface 64 is provided. The diameter of the cylindrical outer surface 62 is substantially the same as the diameter of the cylindrical inner surface 48 so that there is an interference fit therebetween to prevent relative movement therebetween. The bushing 60 has an axial length less than the axial length of the cylindrical inner surface 48 so as to form an abutment shoulder 66. The diameter of the cylindrical inner surface 64 is slightly larger than the diameter of the generally cylindrical outer surface 56 to permit axial movement of the piston rod 54 between the closed and opened positions. The diameter of the generally cylindrical outer surface 56 is less than the diameter of the generally cylindrical inner surface 48 so as to form an annular opening 68 therebetween. The piston 52 has an annular abutment groove 70 formed therein. A coiled spring 72 surrounds the outer surface 56 and extends between and is in contact with the abutment shoulder 66 and the annular abutment groove 70 to exert a resilient force on the piston 52 to urge it toward the closed position. As explained below, the force exerted by the coiled spring 72 is minimal and, if desired, can be omitted.

The valve body 42 has another end portion 80 having a generally cylindrical inner surface 82 and a conical inner surface 84 extending between the generally cylindrical inner surfaces 48 and 82. The piston 52 has a generally cylindrical outer surface 86 having a diameter slightly less than the diameter of the cylindrical inner surface 82 so that the piston 52 may have axially sliding movement through the cylindrical inner surface 82 to permit the piston 52 to move between the closed and opened positions. A sealing gasket 88 is mounted in an annular groove 90 to provide a fluid tight seal between the generally cylindrical inner surface 82 and the generally cylindrical outer surface 86. The piston 52 has a generally conical outer surface 92 which extends between the generally cylindrical outer surfaces 56 and 86. When the air stripping apparatus 2 is in the closed position, as illustrated in FIG. 1, an annular cavity 94 is located between the valve body 42 and the piston 52 and piston rod 54. A vent passageway 96 is formed in the valve body 42 and is in fluid communication with a vent passageway 98 which is open to atmospheric pressure.

Sealing means 102 are provided for sealing the piston rod 54 from the supply of fluid under pressure in the internal cavity 40. The sealing means 102 comprise a hollow cup shaped member 104 having a generally cylindrical inner surface 106 that has a diameter slightly larger than the diameter of the generally cylindrical outer surface 56 so that, when the hollow cup shaped member 104 is mounted thereon, there is a friction fit. The hollow cup shaped member 104 has a closed end 108. The hollow cup shaped member 104 has aligned openings 110 and the piston rod 54 has aligned openings 112 aligned with the aligned openings 110 so that a pin member 114 may be passed therethrough in a frictional relationship to hold the hollow cup shaped member 104 onto the piston rod 54. The hollow cup shaped member 104 has a conical surface 116 dimensioned to mate with a conical surface 118 on the valve body 42. When the forces resulting from the resilient coiled spring 72, the pressurized air in the internal cavity acting on the closed end 108 and the inertial forces acting on the piston 52 and the piston rod 54 have moved the piston 52 and piston rod 54 to the closed position, as illustrated in FIG. 1, the conical surfaces 116 and 118 are in a sealed relationship to prevent flow of fluid under pressure from the internal cavity 40 to the openings 28 in the one end of the passageway 26. The force exerted by the coiled spring 72 needs only to be minimal since the fluid under pressure exerts a force on the closed end 108 to hold the conical surfaces 116 and 118 in the sealed relationship once the sealed relationship has been established.

Figure 3:
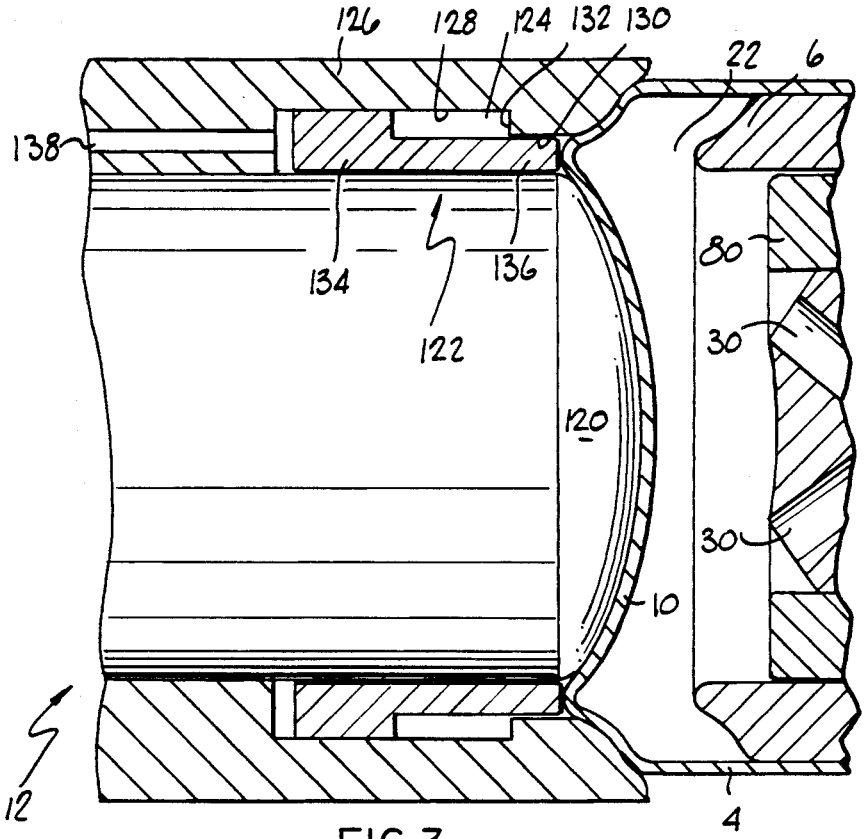
FIG. 3 is an elevational view with parts in section of the apparatus when the cylindrical support device is moving in the return stroke.
Figure 4:
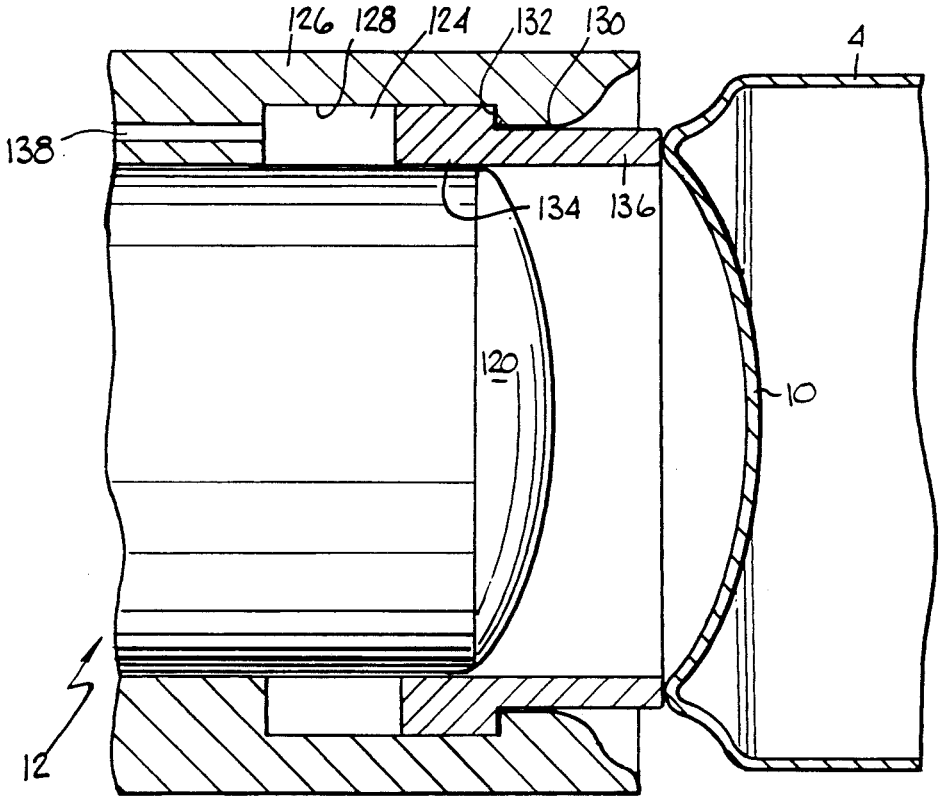
FIG. 4 is an elevational view with parts in section of the cylindrical workpiece being ejected from the doming means.

As illustrated in FIG. 3, the leading portion 120 of the doming means 12 is within the domed closed end 10 when the cylindrical supporting device 6 is moving in its return stroke and will have a tendency to remain there after the cylindrical workpiece 4 has been removed from the cylindrical supporting device 6. Force applying means 122 are provided for separating the closed end 10 from the leading portion 120. The force applying means 122 comprise an annular recess 124 formed in the movable portion 126 of the doming means 12 and having a generally cylindrical inner surface 128 and a generally cylindrical inner surface 130 having a diameter smaller than the diameter of the inner surface 128 to form an abutment shoulder 132 therebetween. An annular piston 134 is mounted for sliding movement over the inner surface 128 and has a projecting portion 136. A passageway 138 connected to a supply of fluid under pressure (not shown) urges the piston 134 toward the abutment shoulder 132. As soon as the cylindrical workpiece 4 is stripped from the cylindrical supporting device 6, FIG. 4, the fluid under pressure will move the piston 134 toward the abutment shoulder 132 to move the projecting portion 136 to exert a force on the domed closed end 10 to move the cylindrical workpiece 4 away from the doming means 12.

The operation of the air stripping apparatus 2 is illustrated in FIGS. 1 and 2. In FIG. 1, there is illustrated the position of the air stripping apparatus 2 during the forward stroke of the reciprocating ram 8 at the time when the closed end 10 of the cylindrical workpiece 4 has contacted the projecting portion 136 and moved the piston 134 in the cavity 124. As the forward stroke of the reciprocating ram is continued, the leading portion 120 causes the closed end 10 to contact the piston 52 and start to move the piston 52 and piston rod 54 in an axial direction to overcome the force of the resilient spring 72 and the pressurized air. The forward stroke of the reciprocating ram 8 is continued and the closed end 10 moves the piston 52 and piston rod 54 to the opened position illustrated in FIG. 2. Any air in the annular cavity 94 is pushed out through the vent passageways 96 and 98 to the atmosphere. In the opened position, the openings 28 are in fluid communication with the supply of fluid under pressure in the internal cavity 40 so that fluid under pressure moves through the passageway 26 and out through the openings 30 into the cavity 22 to exert a force against the closed end 10. The supply of fluid under pressure actually commences as soon as the openings 28 are moved into fluid communication with the internal cavity 40. The reciprocal ram 8 then starts the return stroke. The fluid under pressure in the cavity 22 exerts a force on the closed end 10 to hold the closed end 10 against the doming means 12 as the cylindrical supporting device 6 moves in an axial direction relative to the cylindrical workpiece 4. The fluid under pressure also acts against the piston 52 to hold the piston 52 and the piston rod 54 in the opened position until the cylindrical workpiece 4 has been stripped from the cylindrical supporting device 6. The fluid under pressure in the cavity 22 also overcomes the inertial forces generated by the relative movement of the cylindrical supporting device 6 and piston 52 and piston rod 54, the forces of the resilient spring 72 urging the piston 52 toward the closed position the forces of the fluid under pressure acting on the closed end 108. In making cylindrical workpieces 4 of a particular type designed to operate at internal pressures not exceeding 70 psi having an internal diameter of about 2.5 inches and an axial extent of about 6.0 inches, the fluid in the cavity 22 is at a pressure between about 50 and 65 psi and preferably about 55 psi. As the reciprocating ram 8 moves in the return stroke, the valve means 20 moves with it but the fluid continues to exit through the openings 30 to hold the closed end 10 against the doming means 12. As the cylindrical supporting device 6 moves away from the closed end 10, the fluid under pressure in the cavity 22 must be great enough to overcome the force of the coiled spring 72 and the inertial force acting on the piston 52 and piston rod 54 to retain the piston 5 and the piston rod 54 in the opened position. As soon as the cylindrical supporting device 6 moves out of the cylindrical workpiece 4, the resilient spring 72, the inertial forces and the fluid under pressure in the internal cavity 40 on the closed end 108 move the piston 52 and the piston rod 54 to the closed position. The piston 134 then moVes the projecting portion 136 to moVe the cylindrical workpiece 4 out of the doming means 12.

Figure 5:
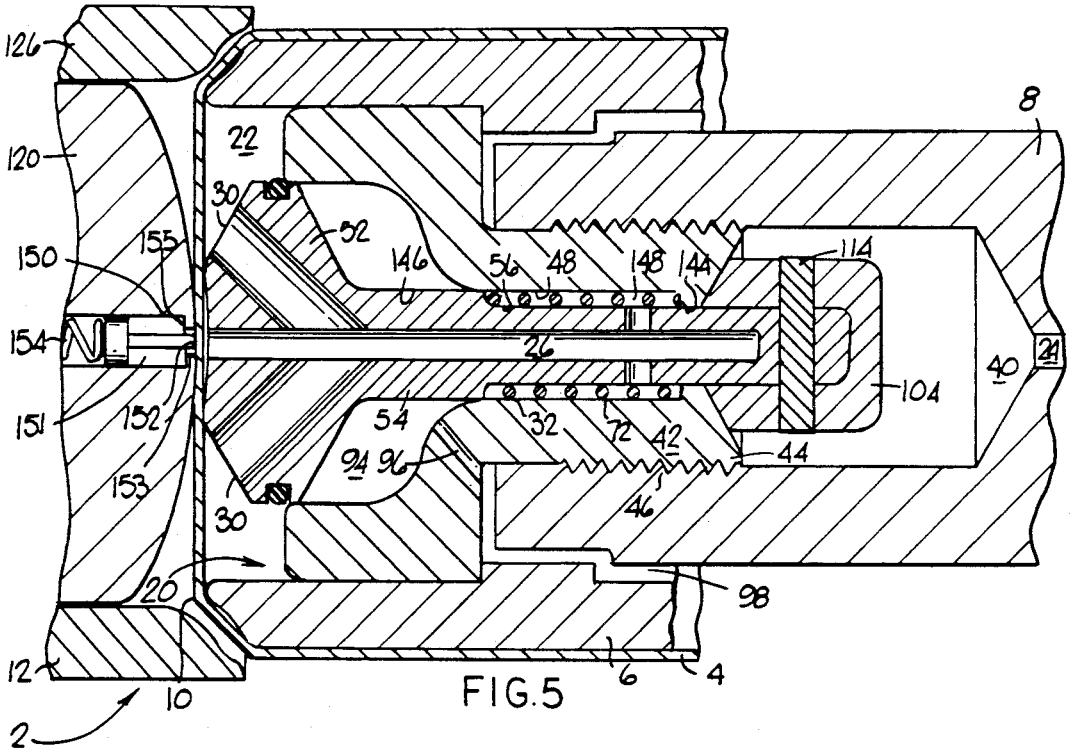
FIG. 5 is an elevational view with parts in section of another preferred embodiment of the invention in a closed position.
Figure 6:
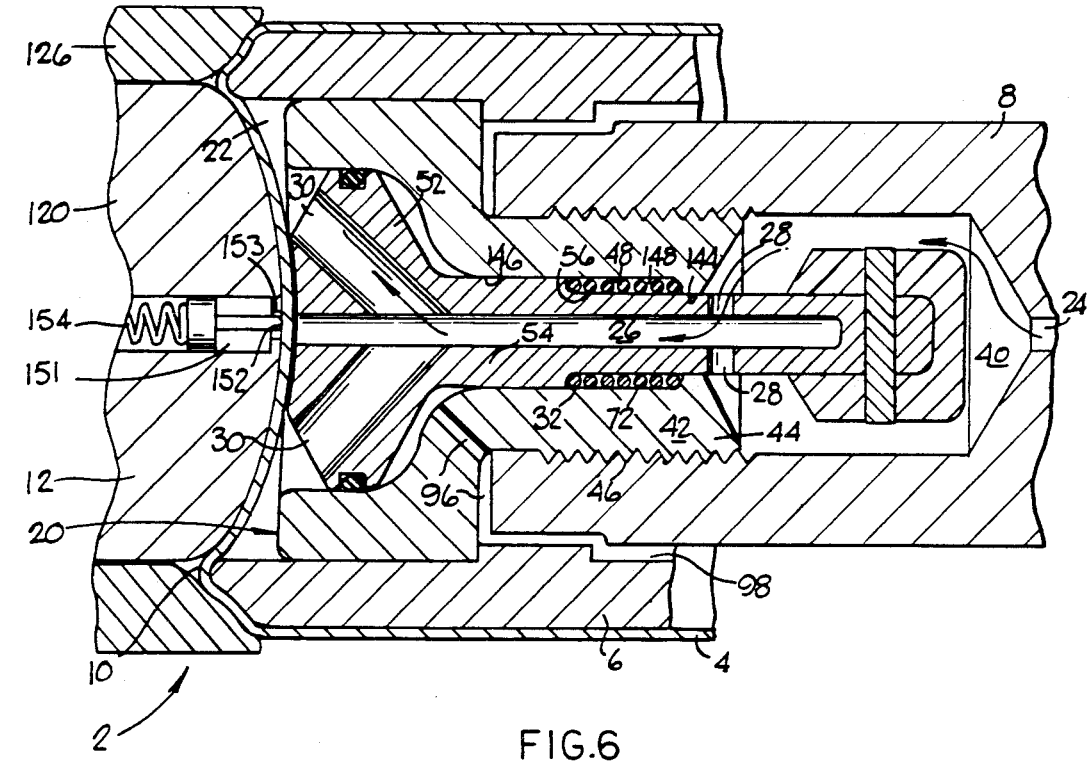
FIG. 6 is an elevational view as in FIG. 5 with the invention in an opened position.

The preferred embodiment of the invention illustrated in FIGS. 5 and 6 is similar to the embodiment illustrated in FIGS. 1 and 2 and corresponding parts have been given the same reference numerals. In FIGS. 5 and 6, the bushing 60 of FIGS. 1 and 2 has been eliminated. The cylindrical inner surface 48 is provided with a cylindrical inner surface 144 having a smaller diameter and the cylindrical outer surface 56 is provided with a cylindrical outer surface 146 having a larger diameter so as to form an annular opening 148 for the coiled spring 72. The apparatus illustrated in FIGS. 5 and 6 functions in the same manner as the apparatus illustrated in FIGS. 1 and 2.

In FIGS. 5 and 6, the force applying means for ejecting the domed cylindrical workpiece 4 from the doming means comprises a piston 150 slidably mounted in a recess 151 and having a projecting portion 152 extending through an opening 153 in the leading portion 120 to contact the closed end 10 of the cylindrical workpiece 4. A coiled spring 154 urges the piston 150 toward the closed end 10 and into contact with an abutment shoulder 155. As soon as the cylindrical workpiece 4 is stripped from the cylindrical supporting device 6, the coiled spring 154 will move the piston 150 toward the abutment shoulder 155 to move the projecting portion 152 through the opening 153 to exert a force on the domed closed end 10 to move the cylindrical workpiece 4 away from the doming means 12.

Figure 7:
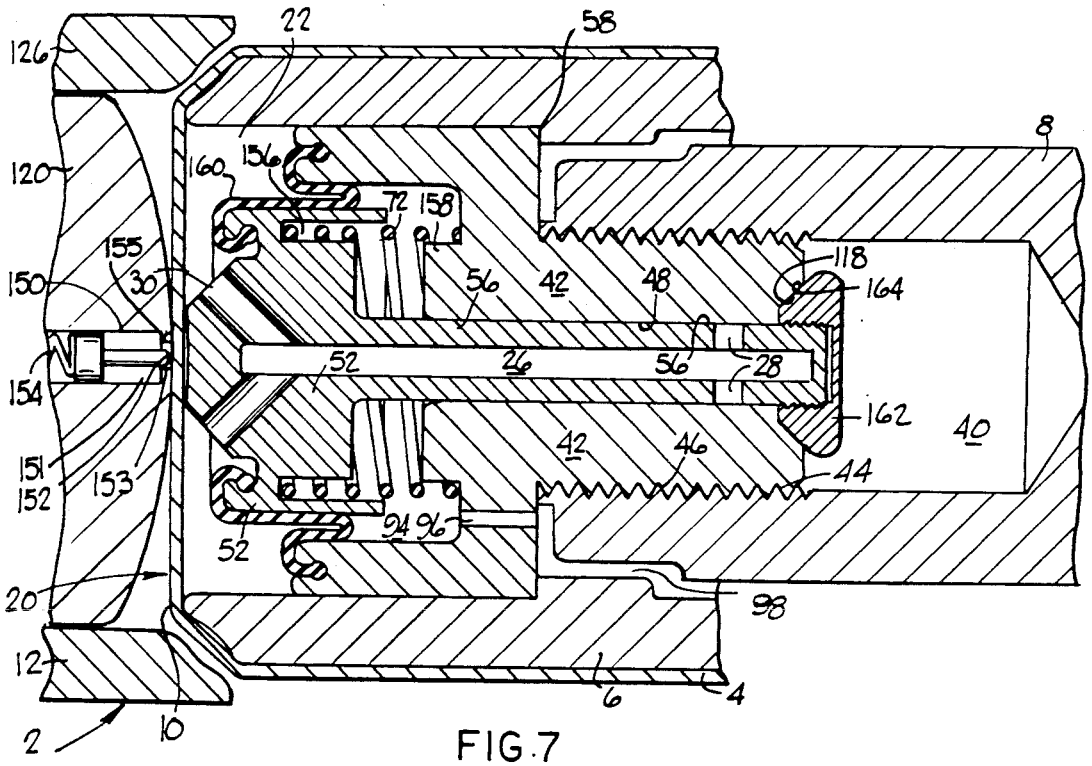
FIG. 7 is an elevational view with parts in section of another preferred embodiment of the invention in a closed position.
Figure 8:
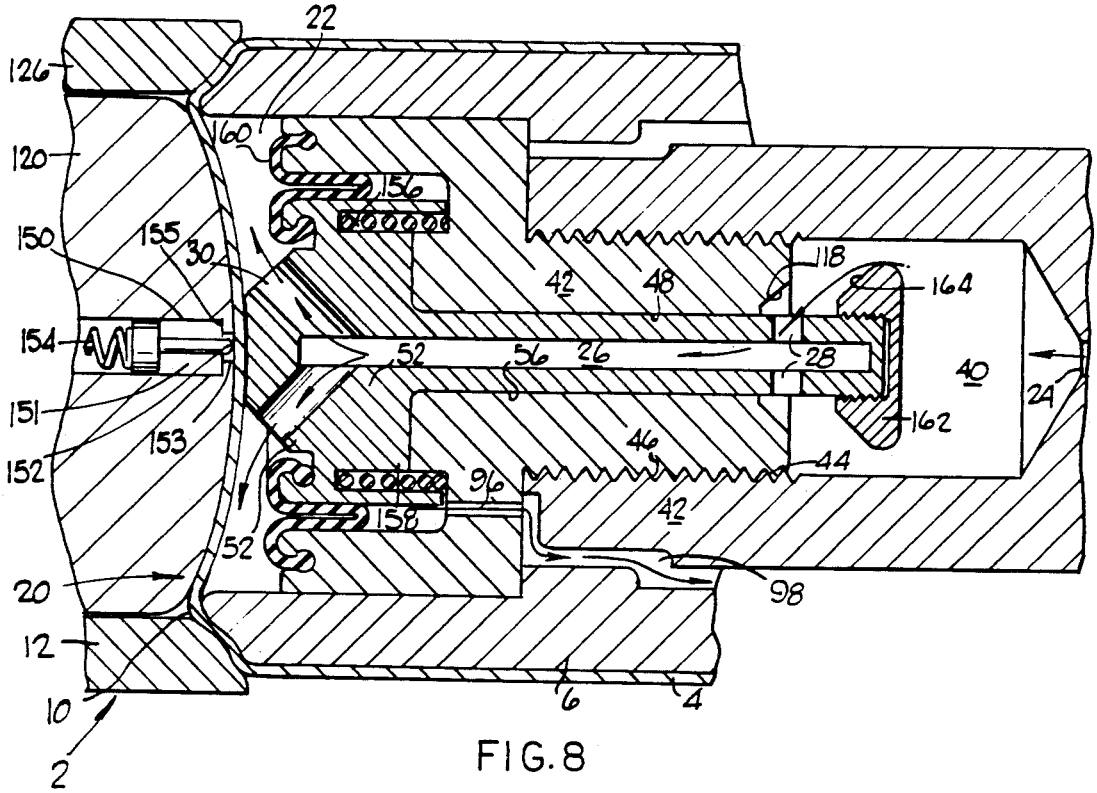
FIG. 8 is an elevational view as in FIG. 7 with the invention in an opened position.

Another preferred embodiment of the invention is illustrated in FIGS. 7 and 8 and is similar to the embodiments illustrated in FIGS. 1, 2, 5 and 6 and corresponding parts have been given the same reference numerals. The piston 52 has an annular recess 156 formed therein and one end of the coil spring 72 is located therein. The valve body 42 has an annular projection 158 over which the other end of the coiled spring 72 is located. A fluid impervious diaphragm 160 extends between the valve body 42 and the piston 52 and is secured thereto in a sealed relationship so as to retain the pressurized fluid in the cavity 22 to hold the cylindrical workpiece 4 against the doming means 12. Sealing means 162 are threaded onto the end of the piston rod 54 and have a conical surface 164 for mating engagement with the conical surface 118 to prevent the fluid under pressure from entering into the passageway 26 when the piston 52 and the piston rod 54 is in a closed position. The apparatus illustrated in FIGS. 7 and 8 functions generally in the same manner as the apparatus illustrated in FIGS. 1 and 2.

Figure 9:
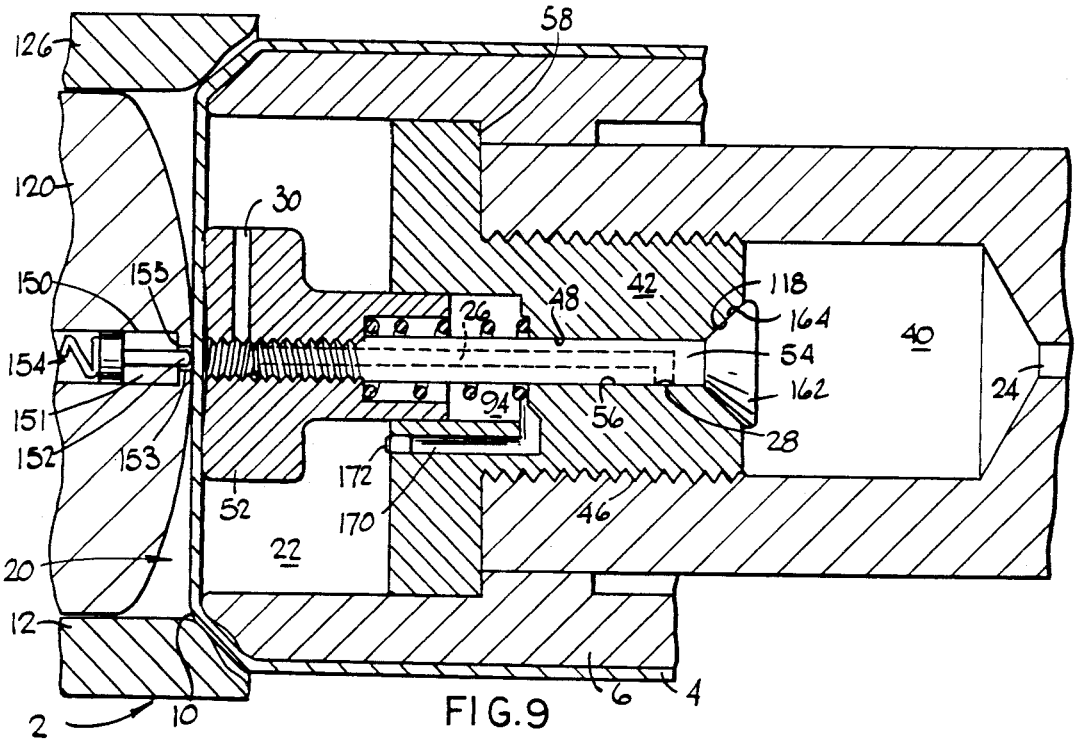
FIG. 9 is an elevational view with parts in section of another preferred embodiment of the invention in a closed position.
Figure 10:
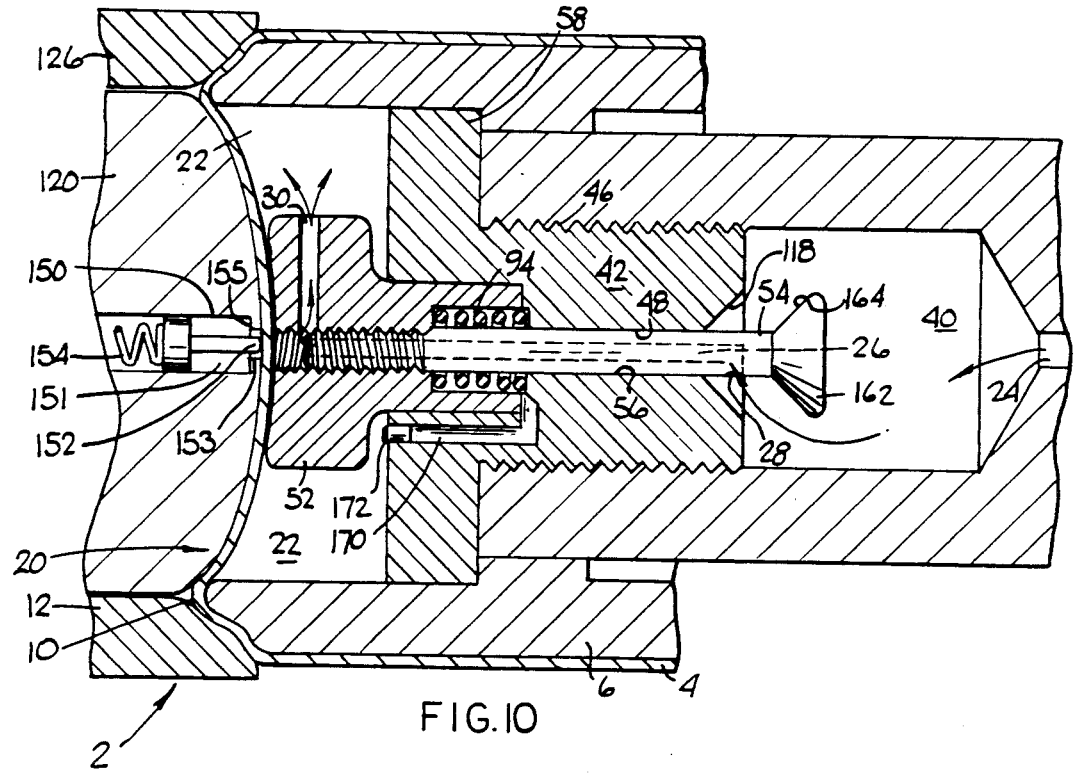
FIG. 10 is an elevational view as in FIG. 9 with the invention in an opened position.

Another preferred embodiment of the invention is illustrated in FIGS. 9 and 10 and is similar to the embodiments illustrated in FIGS. 1, 2 and 5–8 and corresponding parts have been given the same reference numerals. The apparatus illustrated in FIGS. 9 and 10 differs from that illustrated in FIGS. 7 and 8 in that the piston rod 54 is threaded into the piston 52. Also, there is only one opening 28 in the piston rod 54 leading to the passageway 26. A vent passageway 170 is formed in the valve body 42 and is closed by a one way valve 172. This permits the flow of air from the cavity 94 to the cavity 22 as the piston 52 is moved to the closed position. The one way valve 172 prevents flow in the opposite direction. The apparatus illustrated in FIGS. 9 and 10 functions generally in the same manner as the apparatus illustrated in FIGS. 7 and 8.

In the apparatus illustrated in FIGS. 1, 2 and 5–10, it has been determined that the coiled spring 72 is provided primarily to urge the stem portion 50 to a closed position when the apparatus is not operating. Under normal operating conditions, the supply of fluid under pressure in the internal cavity 40 will act against the sealing means 102 or 162 to keep the stem portion in a closed position once this closed position has been established. When the doming means 12 moves the stem portion 50 to the opened position, the pressurized air in the cavity 22 will hold the stem portion 50 in the opened position. After the cylindrical workpiece 4 has been stripped from the cylindrical supporting device 6, the cavity 22 between the valve means 20 and the closed end 10 is opened to atmosphere. The forces of the resilient spring 72, the inertial forces and the forces of the fluid under pressure on the sealing means 102 or 162 move the valve means 20 to the closed position. Therefore, the amount of force required from the coiled spring 72 is only a minimum amount. However, it is possible that changes in the structures of the various components could require a coiled spring 72 of greater force to ensure that the stem portion 50 is returned to the closed position.

It is contemplated that the inventive concepts herein described may be variously otherwise embodied and it is intended that the appended claims be construed to include the alternative embodiments of the invention except insofar as limited by the prior art.

What is claimed is:

1. Apparatus for stripping a cylindrical workpiece, such as a can body, from a cylindrical supporting device, such as a punch on a reciprocating ram of a can body making apparatus, comprising:

a cylindrical supporting device mounted on said ram for reciprocal movement therewith, said reciprocal movement having a forward stroke and a return stroke along a longitudinal axis;

said cylindrical supporting device having a cylindrical workpiece supported thereon, said cylindrical workpiece having a closed end and an open end;

doming means located to be contacted by said closed end of said cylindrical workpiece as said cylindrical supporting device is moving in said forward stroke;

valve means having a movable stem portion for movement between closed and opened positions mounted on said cylindrical supporting device;

a supply of fluid under pressure;

said valve means mounted on said cylindrical supporting device so that a cavity is formed between at least a portion of said valve means and said closed end of said cylindrical workpiece;

force applying means for applying a force on said movable stem portion so that it is normally in said closed position;

at least one passageway extending through said stem portion and when said stem portion is in an opened position, said passageway having one end thereof in fluid communication with said supply of fluid under pressure and the other end thereof in fluid communication with said cavity; and moving means for moving said stem portion from said closed position to said opened position so that said fluid under pressure moves through said at least one passageway into said cavity to apply forces on said closed end to prevent axial movement of said cylindrical workpiece as said cylindrical supporting device moves in said return stroke to strip said cylindrical workpiece from said cylindrical supporting device.

2. Apparatus as in claim 1 and further comprising:

retaining means for retaining said stem portion in said opened position until said cylindrical supporting device has moved out of said cylindrical workpiece.

3. Apparatus as in claim 1 and further comprising:

closing means for returning said stem portion to said closed position.

4. Apparatus as in claim 3 wherein said closing means includes:

said fluid under pressure applying a force on said stem portion urging said stem portion to said closed position.

5. Apparatus as in claim 1 wherein said valve means comprises:

an internal cavity formed in the end portion of said ram;

at least one longitudinally extending passageway in said ram having one end thereof in fluid communication with said supply of fluid under pressure and the other end thereof in fluid communication with said internal cavity;

a valve body having one end portion thereof mounted in said internal cavity;

at least one longitudinally extending passageway having an inner surface in said valve body;

said valve body having an end surface facing said internal cavity;

said stem portion comprising a piston and a piston rod mounted in said passageway in said valve body for movement between said closed and opened positions;

said at least one passageway extending through said piston and piston rod;

one end of said passageway in said piston and piston rod being in fluid communication with said cavity when said valve means is in a closed or an opened position;

the other end of said passageway in said piston and piston rod being radially opposite said inner surface when said valve means are in said closed position so that said other end is not in fluid communication with said supply of fluid under pressure; and the other end of said passageway in said piston and piston rod being in fluid communication with said internal cavity when said valve means are in said opened position so that fluid under pressure moves through said at least one passageway in said piston and piston rod and into said cavity.

6. Apparatus as in claim 5 and further comprising:

sealing means between said valve body and said piston and piston rod when said valve body is in said closed position to prevent entry of said fluid under pressure into said passageway in said piston and piston rod.

7. Apparatus as in claim 6 wherein said sealing means comprises:

a recess having an outer surface formed in said end surface of said valve body facing said internal cavity; and an enlarged head portion on said piston rod having an outer surface for mating engagement with said conical surface of said recess.

8. Apparatus as in claim 7 wherein said enlarged head portion comprises:

a hollow cup shaped member having a closed end and an open end;

said hollow cup shaped member having a cylindrical inner surface having a diameter slightly greater than the outer surface of said piston having the smaller diameter;

said outer surface being on said hollow cup shaped member next adjacent to said open end; and securing means for securing said hollow cup shaped member to said piston rod to prevent relative movement therebetween.

9. Apparatus as in claim 5 and further comprising:

said inner surface of said valve body having at least two cylindrical portions of differing diameters;

said piston and said piston rod having outer cylindrical surfaces of differing diameters;

the portion of said inner surface having the smaller diameter and said piston rod being in mating engagement to guide the movement of said piston rod between said closed and opened positions;

the portion of said inner surface having the larger diameter having a diameter larger than the diameter of said piston so that an annular space exists therebetween; and a diaphragm mounted on said valve body and said piston to seal off said annular space.

10. Apparatus as in claim 5 and further comprising:

said inner surface of said valve body having at least two cylindrical portions of differing diameters;

said piston and said piston rod having outer surfaces of differing diameters; and said inner surfaces and said outer surfaces being in mating engagement to guide the movement of said piston and piston rod between said closed and opened positions.

11. Apparatus as in claim 5 and further comprising:

an annular space located between said piston and said valve body; and vent means for connecting said annular space to atmospheric pressure.

12. Apparatus as in claim 5 and further comprising:

an annular space located between said piston and said valve body;

another passageway in said piston extending between said annular space and said cavity; and an one way valve in said passageway for permitting flow of a fluid only in the direction from said annular space to said cavity.

13. Apparatus as in claim 1 and further comprising:

additional force applying means for applying a force to said closed end to move said closed end in an axial direction away from said doming means.

14. Apparatus as in claim 13 wherein said additional force applying means comprises:

an outer surface on said doming means for contacting said closed end;

an inner surface formed in said doming means and having an opening in said outer surface;

a piston mounted for limited reciprocal movement over said inner surface;

said piston having a projecting portion adapted to contact said closed end; and another force applying means for applying a force on said piston to urge said projecting portion into contact with said closed end to move the stripped away cylindrical workpiece away from said doming means.

15. Apparatus as in claim 14 wherein:

the cross-sectional configurations of said inner surface and said piston are cylindrical.

16. Apparatus as in claim 13 and further comprising:

retaining means for retaining said stem portion in said opened position until said cylindrical supporting device has moved out of said cylindrical workpiece.

17. Apparatus as in claim 13 and further comprising:

closing means for returning said stem portion to said closed position.

18. A method for stripping a cylindrical workpiece, such as a can body, from a cylindrical supporting device, such as a punch on a reciprocating ram of a can body making apparatus, comprising:

reciprocating said cylindrical supporting device along a longitudinal axis in a forward stroke and a return stroke;

supporting said cylindrical workpiece having an open end and a closed end on said cylindrical supporting device so that a cavity is formed between said cylindrical supporting device and said closed end;

mounting doming means at a relatively fixed location to be contacted by said closed end during said forward stroke;

mounting valve means on said cylindrical supporting device so that said cavity is between said valve means and said closed end, said valve means having a stem portion for movement between closed and opened positions;

urging said stem portion toward said closed position;

maintaining a supply of fluid under pressure;

connecting said stem portion to said supply of fluid under pressure;

moving said closed end of said cylindrical workpiece into contact with said doming means during said forward stroke;

continuing said movement of said closed end in said forward stroke so that said closed end is deformed and moves into contact with said stem portion to move said stem portion from said closed position to said opened position;

feeding fluid under pressure through said stem portion in said opened position to hold said closed end of said cylindrical workpiece against said doming means while moving said cylindrical supporting device in said return stroke to remove said cylindrical workpiece from said cylindrical supporting device; and retaining said stem portion in said opened position until said cylindrical workpiece has been stripped from said cylindrical supporting device.

19. A method as in claim 18 and further comprising:

moving said stripped cylindrical workpiece out of said doming means.

* * * * *